US009345329B2

(12) United States Patent
Gendell

(10) Patent No.: US 9,345,329 B2
(45) Date of Patent: May 24, 2016

(54) C-FOLDING CHAIR

(71) Applicant: Alexander Gendell, Hoboken, NJ (US)

(72) Inventor: Alexander Gendell, Hoboken, NJ (US)

( * ) Notice: Subject to any disclaimer, the term of this patent is extended or adjusted under 35 U.S.C. 154(b) by 0 days.

(21) Appl. No.: 13/999,970

(22) Filed: Apr. 10, 2014

(65) Prior Publication Data

US 2015/0289657 A1 Oct. 15, 2015

(51) Int. Cl.
*A47C 4/04* (2006.01)

(52) U.S. Cl.
CPC ..... *A47C 4/04* (2013.01)

(58) Field of Classification Search
CPC ..... A47C 4/04; A47C 4/08; A47C 4/20; A47C 4/44
USPC ..... 297/16.1, 46, 48, 58
See application file for complete search history.

(56) References Cited

U.S. PATENT DOCUMENTS

| | | | | | |
|---|---|---|---|---|---|
| 1,752,306 | A * | 4/1930 | Marson | ..... | 297/48 |
| 1,765,942 | A * | 6/1930 | Schermerhorn | ..... | 297/48 |
| 1,842,793 | A * | 1/1932 | Marson | ..... | 297/48 |
| 2,107,764 | A * | 2/1938 | Puls | ..... | 297/48 |
| 2,757,715 | A * | 8/1956 | Hendrickson | ..... | 297/58 |
| 2,794,491 | A * | 6/1957 | Hopkins | ..... | 297/48 |
| 4,556,249 | A * | 12/1985 | Kassai | ..... | 297/30 |
| 2012/0242114 | A1 * | 9/2012 | Boucquey | ..... | 297/30 |

* cited by examiner

*Primary Examiner* — Peter Brown
(74) *Attorney, Agent, or Firm* — Douglas C. Wyatt

(57) ABSTRACT

A folding chair having seat, backrest, front leg, and rear leg interconnected with backrest pivoted to front leg and back leg, and seat pivoted to front leg and back leg so as to lock backrest when chair is unfolded, and when weight is applied to the seat a force is applied further locking the backrest. A modification provides a folding chair with outer and inner frames for locking backrest and rear leg in position when chair is unfolded for use.

13 Claims, 9 Drawing Sheets

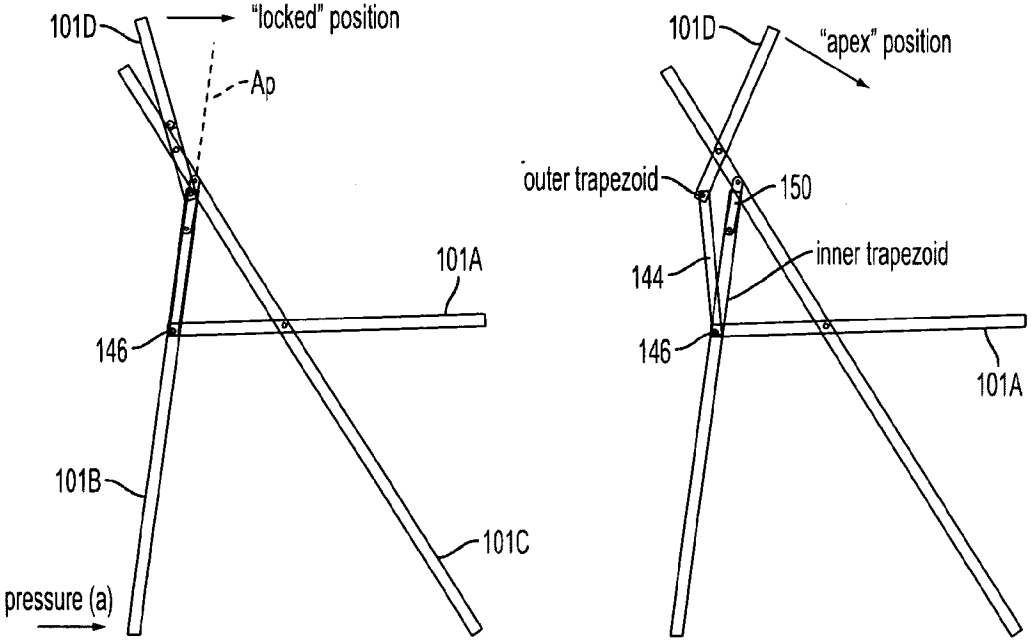
FIG. 9A
FIG. 9B
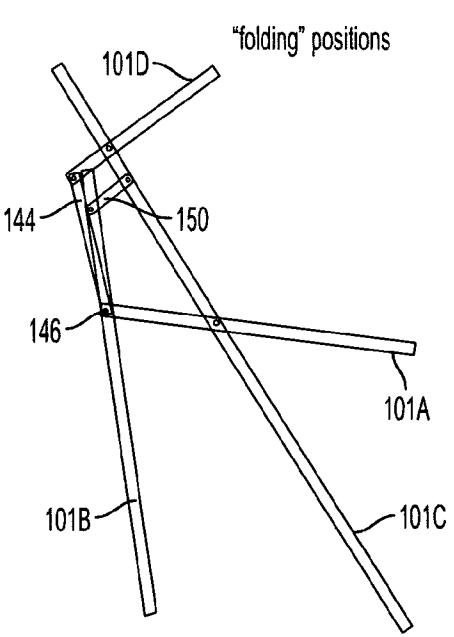
FIG. 9C

C-FOLDING CHAIR

PRIORITY

This application claims priority of U.S. Provisional Application Ser. No. 61/853,752 dated Apr. 11, 2013 entitled C-Folding Chair the entire contents of which are all relied upon and are fully incorporated herein by reference.

FIELD OF THE INVENTION

The field of invention relates to folding chairs. The present invention is directed to embodiments of side folding chairs with component members that lock when the chair is unfolded for use and further lock when pressure is applied to the chair seating member.

BACKGROUND OF THE INVENTION

In commonly used folding chair designs, the backrest is a rigid part of the front leg members, the seat is pivoted to both front and rear leg members, and the front and rear leg members are pivoted to each other by connecting links at leg locations above the seat. When the chair is unfolded the top surface of rear leg members engage and brace against front leg members at a point between seat surface and backrest. In such position unfolding motion is complete, and weight applied to the seat and backrest is fully taken to ground by front and rear leg members. Folding motion of the chair is completed by engagement of bottom ends of front legs with lower ends of rear legs, in which position is chair may be stored.

SUMMARY OF THE INVENTION

The present invention is directed to embodiments for side folding chairs in which a chair unfolded to a sitting position is locked, and then further locked when force is applied to the seating member of the chair.

In one embodiment of folding chair comprising seat, rear leg, front leg, and backrest, the back rest is pivoted to top of rear leg and to front leg at a point above rear leg pivot. The chair has three positions: (i) locked position in which force applied to the seat by a person sitting causes chair structure to further lock itself by pushing the backrest inward (toward sitting person's back); (ii) an apex position where pivot points of backrest and legs are aligned and seat rises slightly to ensure chair does not fold if sat upon; and (iii) folding position where backrest is pivoted on front leg inward toward the seat and the seat is pivoted on front leg to full folded position.

In another embodiment of the invention, the pivoting connections of backrest to front leg and to rear leg are modified. In this embodiment of folding chair comprising seat, rear leg, front leg, and backrest, the backrest is pivoted to front leg at a point above rear leg, and is also pivoted by first connecting link to a common pivot point shared by rear leg and seat. A second pivoting connecting link extends between rear and front legs at points below the backrest. The first linkage between backrest and common pivot and second linkage between rear and front legs define, respectively, an outer frame and an inner frame. In this embodiment, the inner frame limits movement of the outer frame and backrest from locked to apex position. Also, the seating member does not move upward as in the first embodiment described above, but strain is passed onto the structural members. So one of the structural members must flex enough to allow passing the apex position of backrest and rear leg. In a preferred arrangement the U-shaped upper part of the front leg member flexes. Such flexing causes the chair to "snap" into locked position. A further benefit is that any force applied onto the rear leg (as by an occupant tilting the chair back on rear legs) cannot cause the chair to fold, because the leg is not connected to the locking outer frame.

Specific examples are included in the following description for purposes of clarity, but various details can be changed within the scope of the present invention.

OBJECTS OF THE INVENTION

An object of the invention is to provide a folding chair that locks position of backrest and front and rear legs when the chair is unfolded for use.

Another object of the invention is to provide a folding chair that locks when set up for use, and which is locked further by downward force on the seating member.

Another object of the invention is to provide a folding chair in which a structural member flexes as the chair is unfolded so that the chair snaps into locked position.

Another object of the invention is to provide a folded chair in which the backrest folds downward for a more compact folded shape, and for a folding chair much thinner than common side folding chairs.

Another object of the invention is to provide a folding chair in which the backrest folds down to expose a hook for storing the chair on a hanging rod, and a handle for carrying the chair.

Other and further objects of the invention will become apparent with an understanding of the following detailed description of the invention or upon employment of the invention.

BRIEF DESCRIPTION OF THE DRAWING

Preferred embodiments of the invention have been chosen for detailed description to enable those having ordinary skill in the art to which the invention appertains to readily understand how to construct and use the invention and is shown in the accompanying drawing in which:

FIGS. 9*a-c* are schematic views of the chair of FIG. 6 in sequence from locked to folding positions.

DETAILED DESCRIPTION OF THE PREFERRED EMBODIMENT

Figure 1:
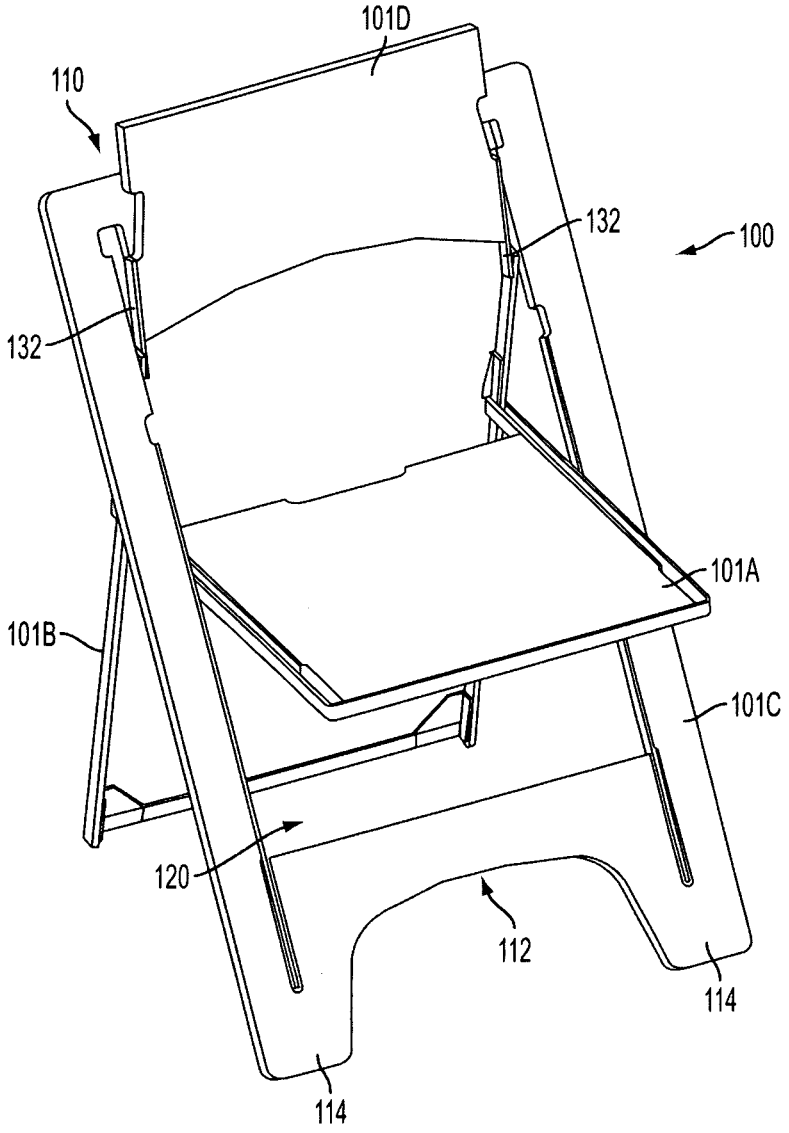
FIG. 1 is a front perspective view of a preferred embodiment of a folding chair according to the invention.

Referring to drawing FIGS. 1-5, a preferred embodiment of folding chair 100 comprises seat 101A, rear leg 101B, front leg 101C, and backrest 101D, and pivots between seat and front leg 104A; seat and rear leg 104B; backrest and rear leg 104C; and backrest and front leg 104D.

Front leg 101C includes upright leg members with connecting upper 110 and lower cross 112 members between upper and lower ends of the leg members. The lower cross member is recessed to define leg bases 114, and the upper cross member has an interior opening defining a handle 116 for carrying the chair, and an upwardly open recess 118 defining a hook for suspending the chair from a hanging rod.

The arrangement of leg members and cross members define a generally rectangular open interior area 120 in which seat and backrest are mounted, and which interior area accommodates both seat and back rest of folded chair allowing a compact shape much thinner than conventional side folding chairs (FIGS. 4 and 5).

The seat 101A comprises a generally rectangular or square plate with channels 122 alongside edges by which seat is hinged or pivoted to front legs and rear legs. Preferably, each channel extends beyond rear seat margin for pivot connection 104B to rear legs. In an alternative embodiment, each leg can be provided with a stop 124 to limit movement of backrest into the open area when the chair is folded.

Rear leg 101B comprises a pair of upright struts 126 with cross piece 128 connecting lower ends and reinforcing corner plates 130. The rear legs pivot with seat channels as noted, and at top end have pivot connections 104C to backrest.

Backrest 101D comprises a plate having brackets 132 along side edges and extending below bottom edge for pivoting connection of seat rest to top ends of rear legs.

Figure 2:
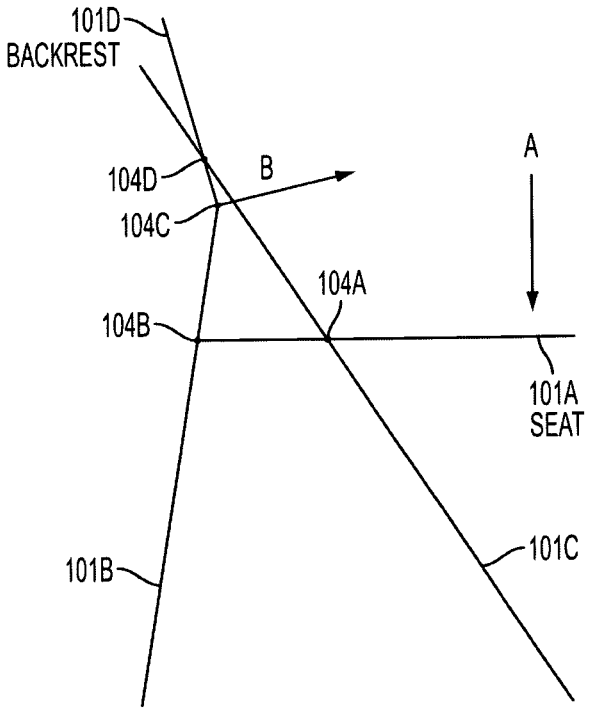
FIG. 2 is a schematic view of the chair of FIG. 1 indicating force A on seat inducing force B to further lock chair.
Figure 3:
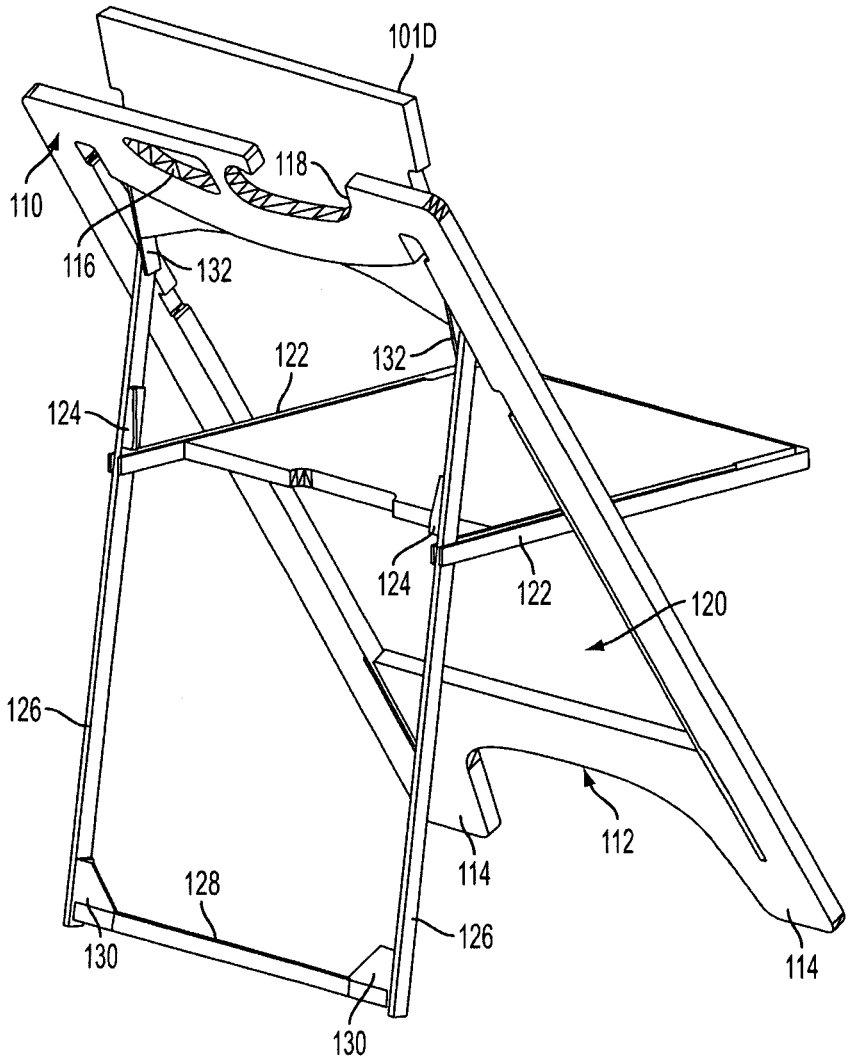
FIG. 3 is a rear perspective view of the chair of FIG. 1.
Figure 4A:
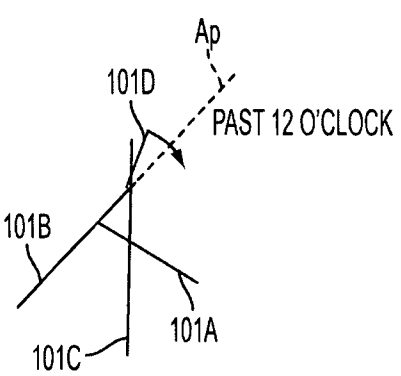
FIG. 4 is a schematic view of the chair of FIG. 1 in sequence from unfolded to folded position.
Figure 4B:
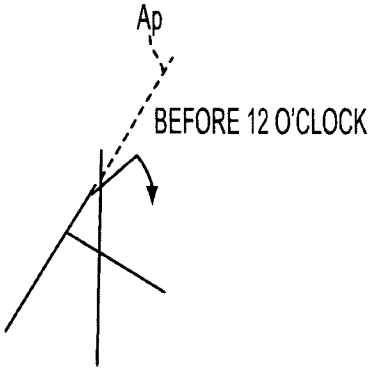
Figure 4C:
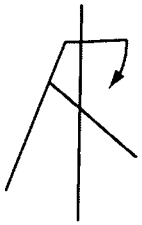
Figure 4D:
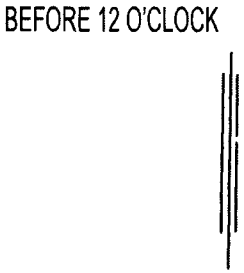
Figure 5A:
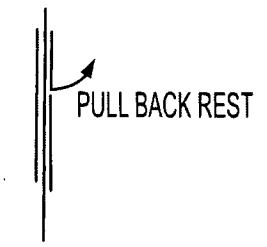
FIG. 5 is a schematic view of the chair of FIG. 1 in sequence from folded to unfolded position.
Figure 5B:
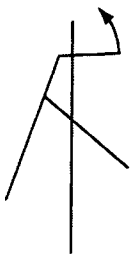
Figure 5C:
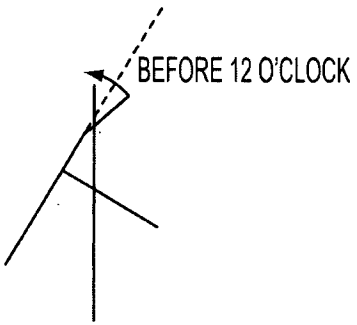
Figure 5D:
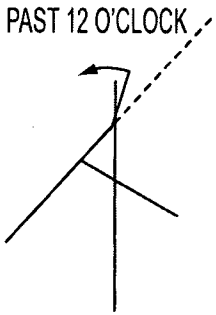

FIGS. 2, 4, and 5 schematically illustrate pivot connections of chair components, as well as folding and unfolding of chair. In FIGS. 2 and 4(1) chair is in unfolded, locked position for use. The backrest lies to the left of 12 o'clock apex $A_p$ position defined extension of by rear leg axis. By applying force A to seat, rear leg applies force B turning backrest on pivot point further beyond apex to further locked position.

For folding the chair as in FIG. 4, the chair is tilted to rest on front leg member, and backrest is pivoted through apex and moved downward to folded position. As the backrest moves downward, the seat also pivots downward through intermediation of rear leg member. By tilting the chair vertically, the weight of the backrest causes the chair structure to fold. Applying pressure on the top of the backrest (without weight of person on seating member) will have same folding effect. FIG. 5 shows unfolding the chair by movement of backrest up, through, and beyond apex to open chair.

The operation of the chair may be described in the following terms. The seat member has a rear end pivoted to the rear leg member and is further pivoted to the front leg member at a point intermediate front and rear ends. The front leg member is inclined toward and passes over the top of the rear leg member. The backrest has a lower end pivoted to the top of the rear leg member and is further pivoted to the front leg member at a point above its connection to the rear leg member. The rear leg member defining an axis and an extension of the axis past the top of the rear leg member defines an apex. In unfolding the chair the backrest passes through the apex to locked position so that force applied to the seat member results in force applied by top of rear leg member to backrest further pushing the backrest to locked position. Moreover, a force applied to the rear leg member, as by chair occupant tilting the chair backward, tends to force the backrest into further locked position.

Referring to drawing FIGS. 6-9, another preferred embodiment of folding chair comprises seat, backrest, front leg, rear leg, and pivots between seat and front leg; seat and rear leg; and backrest and front leg. The configuration of seat, backrest, front leg, rear leg, is the same as those of the embodiment of FIGS. 1-5 as indicated by common reference numerals.

Figure 6:
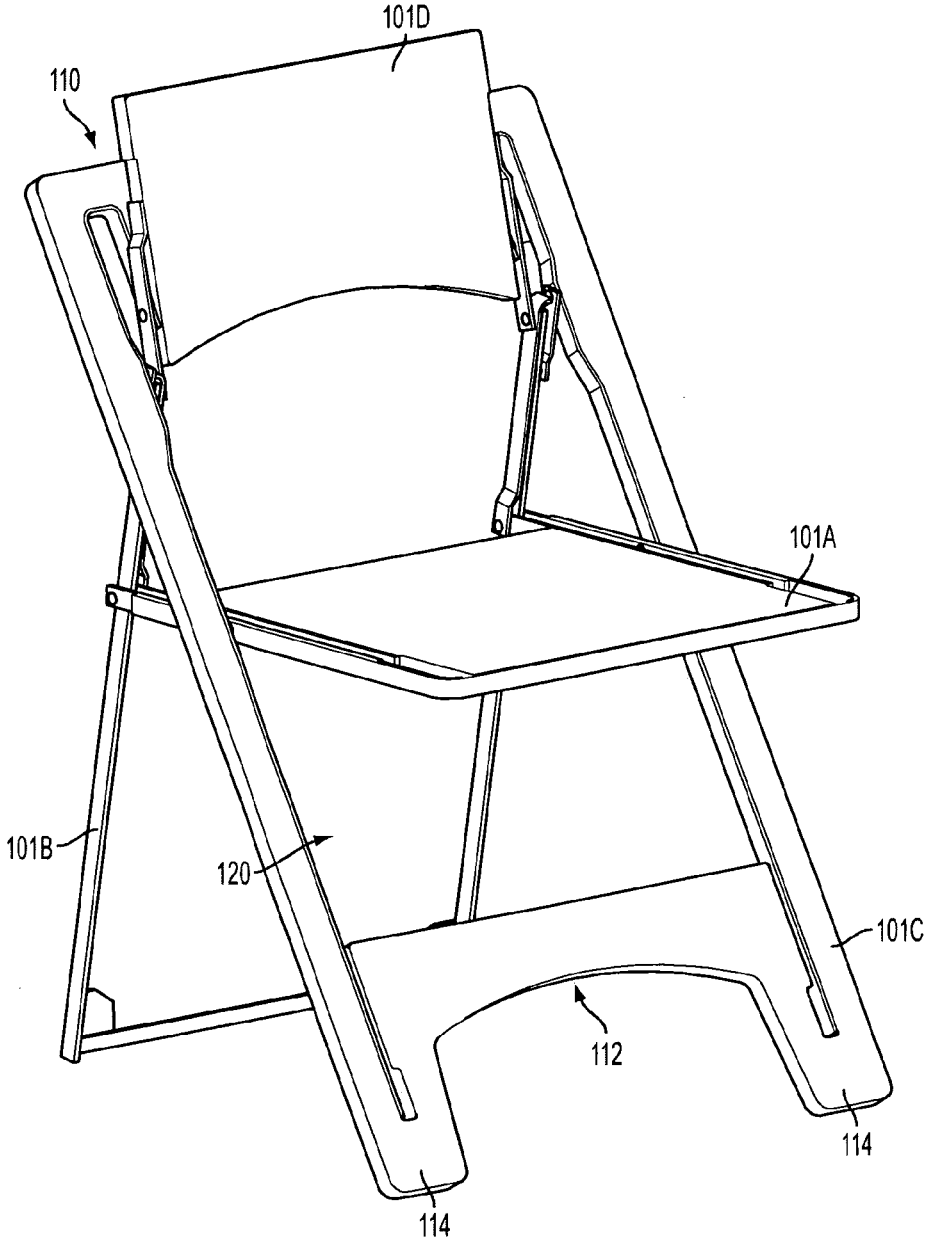
FIG. 6 is a front perspective view of another preferred embodiment of a folding chair according to the invention.
Figure 7:
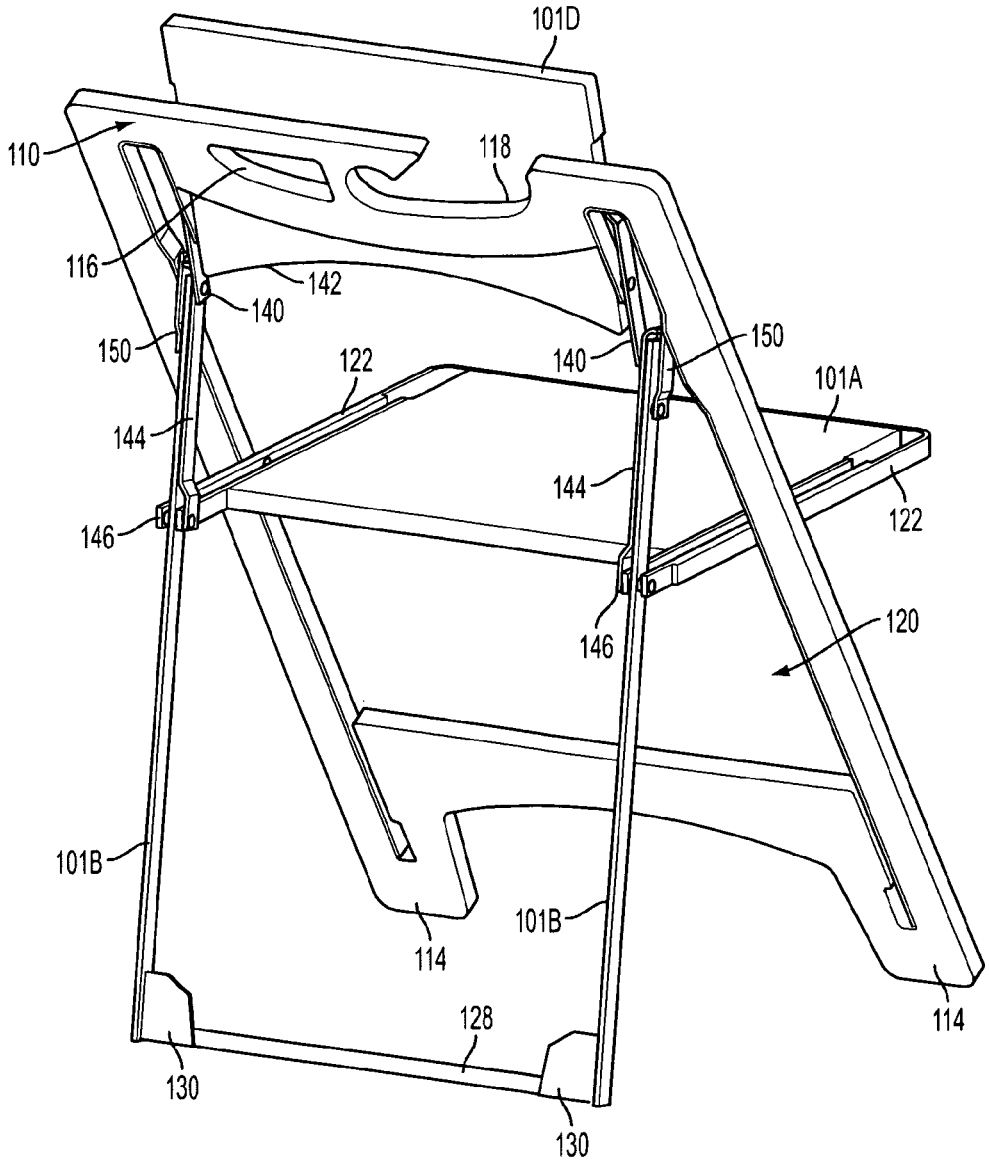
FIG. 7 is a rear perspective view of the chair of FIG. 6.

As best seen in FIGS. 6, 7 and 9, backrest brackets 140 secured to side edges of backrest extend below backrest lower margin 142 and there are pivoted to upper end of backrest locking member 144. At its lower end, backrest locking member pivots on common pivot axis 146 for rear leg 101B and seat 101A. Backrest locking member may be referred to as outer frame that locks backrest with chair in locked position.

As shown in FIGS. 6, 7, and 9 a rear leg locking members 150 are connected by pivot pins to front leg 101C and to rear leg 101B for locking rear leg when the chair is unfolded. Rear leg locking member may be referred to as inner frame.

Beginning with FIG. 9(1), the chair is seen in locked position ready for use. The backrest and rear leg are in locked positions and the backrest is beyond apex $A_p$. In arriving at locked position the outer frame and inner frame "snap" into final position providing user with audible sign that the chair is locked and ready for use. One of the structural members must flex enough to allow passing the apex position of backrest and rear leg. In this embodiment the U-shaped upper part of the front leg member flexes. Such flexing causes the chair to "snap" into locked position.

Figure 8:
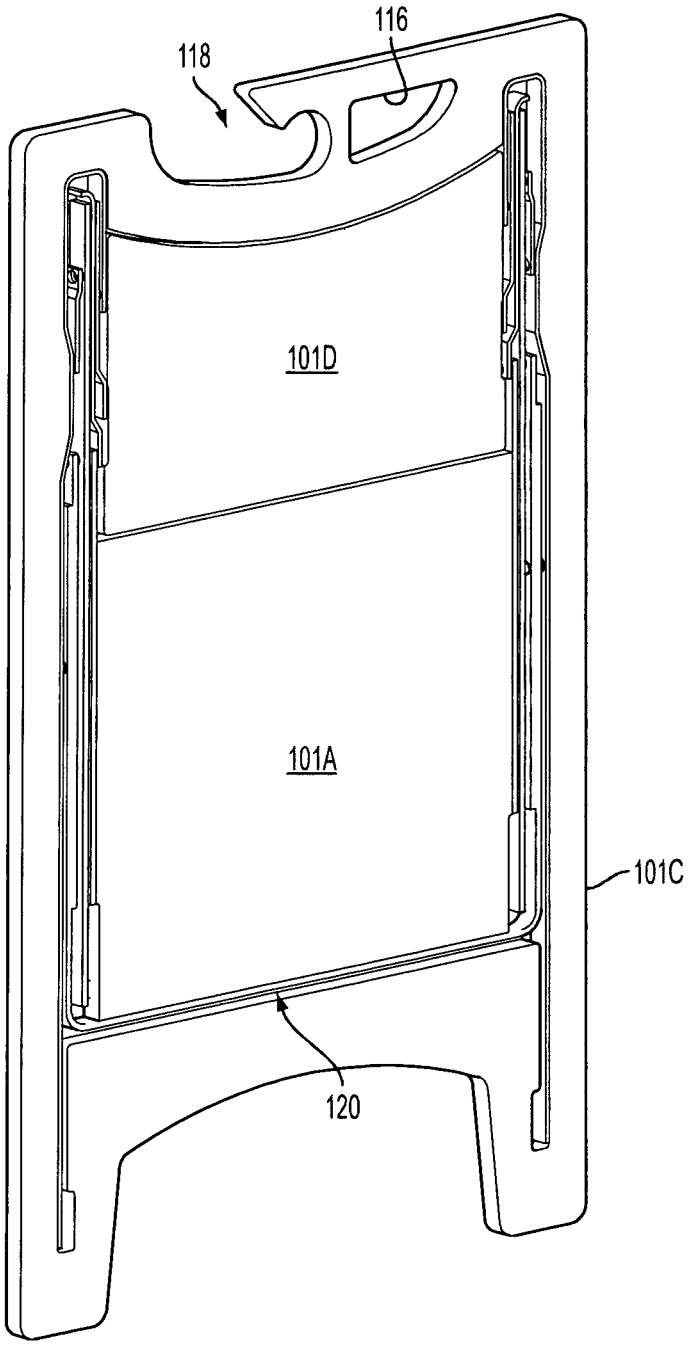
FIG. 8 is a front perspective view of the chair of FIG. 6 in folded position.

To fold the chair, the backrest is moved to FIGS. 9(2) and 9*c* positions unlocking backrest and rear legs, moving seat and backrest downward and bringing chair to folded position of FIG. 8 where seat 101A and backrest 101D are lodged in the open interior space 120 provided by front legs member.

Various changes may be made to the structure embodying the principles of the invention. The foregoing embodiments are set forth in an illustrative and not in a limiting sense. The scope of the invention is defined by the claims appended hereto.

I claim:

1. A folding chair comprising a front leg member, a rear leg member, a backrest member, and a seat member, the seat member having a rear end pivoted to the rear leg member, the seat member further being pivoted to the front leg member, the front leg member being inclined toward and overlying a top portion of the rear leg member when the chair is unfolded, the backrest having a lower end pivoted to the rear leg member, the backrest further pivoted to the front leg member at a point above the lower end of the backrest, the rear leg member having an axis, where an extension of the axis past the top portion of the rear leg member defining an apex, whereby when the chair is unfolded, the backrest passes through the apex to a locked position so that force applied to the seat member results in force applied by the top of rear leg member and to the backrest further pushing the backrest to said locked position.

2. A folding chair as defined in claim 1 in which the front leg member comprises a unitary structure of spaced upright legs having top portions and bottom portions, an upper cross piece extending between the top portions of the legs, and a lower cross piece extending between the bottom portions of the legs, the legs and cross pieces defining an inner space into which the backrest and seat member fold for compact folded shape.

3. A folding chair as defined in claim 2 in which the upper cross piece has an interior recess defining a handle for lifting the chair.

4. A folding chair as defined in claim 3 in which the upper cross piece has an interior recess opening through a margin of the cross piece to define a hook for storing the chair on a hanger.

5. A folding chair as defined in claim 2 in which the inner space is defined by an inner surface in said unitary structure and in which the front leg member pivot points to the backrest member and the seat member are situated at the inner surface.

6. A folding chair as defined in claim 1 in which the rear leg member is fitted with at least one stop for limiting folding movement of the backrest.

7. A folding chair as defined in claim 1 in which the seat member is fitted with channel members along its side edges to accommodate pivot connections to the front leg member and the rear leg member.

8. A folding chair comprising a front leg member, a rear leg member, a backrest member, and a seat member, the seat member having a rear end pivoted to the rear leg member to establish a common pivot point, the seat member further being pivoted to the front leg member, the front leg member being inclined toward and overlying the top portion of the rear leg member when the chair is unfolded, the backrest having a lower end, a backrest locking member having first and second ends, the first end pivoted to the backrest lower end and the second end pivoted to the rear leg member at said common pivot point, the backrest further pivoted to the front leg member at a point above the lower end of the backrest, a rear leg locking member having first and second ends, the first end pivoted to the rear leg member at a point above the common pivot, and the second end pivoted to the front leg member, the rear leg member having an axis, where an extension of the axis past the top portion of the rear leg member defining an apex, whereby when the chair is unfolded the backrest passes through the apex to a locked position with the backrest locking member and the rear leg locking member snapping into locked positions.

9. A folding chair as defined in claim 8 in which the rear leg locking member first end pivots at a point on the front leg member and the intermediate front leg pivotably connects with the backrest member and with the seat member.

10. A folding chair as defined in claim 8 in which the front leg member comprises a unitary structure of spaced upright legs, an upper cross piece extending between the top portions of the legs, and a lower cross piece extending between the bottom portions of the legs, the legs and the cross pieces defining an inner space into which the backrest, seat member, backrest locking member and rear leg locking member fold for compact folded shape.

11. A folding chair as defined in claim 10 in which the inner space is defined by an inner surface in said unitary structure and in which the front leg member is pivotably connected to the backrest member, the seat member, and the rear leg locking member are situated at inner surface.

12. A folding chair as defined in claim 8 in which the backrest locking member includes a pair of brackets each having first and second ends, the first end pivotably connected to the backrest lower end and the second end pivotably connected to the rear leg member at said common pivot point.

13. A folding chair as defined in claim 8 in which the rear leg locking member includes a pair of links each having first and second ends, the first ends pivotably connected to the rear leg members at a points above the common pivot, and the second ends pivotably connected to the front leg members.

* * * * *